United States Patent [19]

Horlitz, Jr.

[11] 4,054,107

[45] Oct. 18, 1977

[54] MARINE WASTE HEAT STEAM GENERATOR

[75] Inventor: Carl Frederick Horlitz, Jr., Bloomfield, Conn.

[73] Assignee: Combustion Engineering, Inc., Windsor, Conn.

[21] Appl. No.: 680,614

[22] Filed: Apr. 26, 1976

[51] Int. Cl.[2] ..... F22B 1/02; F22B 37/36

[52] U.S. Cl. ..... 122/7 B; 122/494

[58] Field of Search ..... 122/7 R, 7 B, 494

[56] References Cited

U.S. PATENT DOCUMENTS

| | | | |
|---|---|---|---|
| 1,925,646 | 9/1933 | Rakestraw | 122/7 B |
| 2,654,352 | 10/1953 | Schoenfeld | 122/494 |
| 2,825,311 | 3/1958 | Smith | 122/7 B |
| 3,053,049 | 9/1962 | Blaskowski | 122/7 R |
| 3,153,402 | 10/1964 | Danko et al. | 122/7 |
| 3,254,634 | 6/1966 | Vorkauf | 122/7 |
| 3,934,553 | 1/1976 | Freeman, Jr. et al. | 122/7 |

FOREIGN PATENT DOCUMENTS

| | | | |
|---|---|---|---|
| 1,181,513 | 4/1966 | United Kingdom | 122/7 |

*Primary Examiner*—Kenneth W. Sprague
*Attorney, Agent, or Firm*—Arthur L. Wade

[57] ABSTRACT

A stem generator with its sections arranged for the limited space available in a marine installation. The heated surfaces are exposed to both the products of combustion of original fuels and the discharge from the prime movers of marine propulsion. The water being vaporized is positively pumped up through the heated surfaces to the short length upper steam separator drum. The superheat surfaces are arranged in modular form so they may be readily replaced and can also be drained of collected liquid when maintenance is required.

5 Claims, 2 Drawing Figures

MARINE WASTE HEAT STEAM GENERATOR

BACKGROUND OF THE INVENTION

1. Field of the Invention

The present invention relates to the small compact form of steam generator evolved for marine use where a waste heat source is available and is supplemented by heat from the direct firing of fuel. More specifically, the invention relates to the marine steam generator which fires original fuel for the first radiant heating of water-tubes and combines the products of combustion with waste heat from diesel or gas turbine engines for the second convection heating of superheat tubes.

2. Description of the Prior Art

Steam generation has included the use of a wide variety and combination of heat sources. Bagasse to nuclear fuel pins have had their heat converted into water vapor for driving turbines which, in turn, drive electric generators. Wherever a source of heat can be created, or is produced as a by-product of a power process, the possibility of steam generation--electric production exists.

The art of combining the heat from different sources in marine installations is now before us. The diesel and gas turbine propulsion units on a ship exhaust large quantities of heat which has been wasted in the past. It is an idea whose time has arrived to convert this combined heat to useful electricity. The steam generator is a vital link in this chain of conversion.

The many uses for electricity on shipboard need not be tabulated. The total need may fluctuate but it is continual. With the need accepted, the steam generator is recognized as the standard source of energy to drive the turbo-generator to produce the electricity. The next step is the implementing of the concept of tying the propulsion unit exhaust and the products of combustion of a fuel burner together in the steam generator.

Basically, a steam generator is defined when a heating media is passed around tubes filled with water. The water is vaporized to steam. It is quite common to burn liquid fuel into a heating media of products of combustion. If the problems of regulating this combustion are mastered, and the radiant heat transferred to water, the heat of the products of combustion can be mixed with whatever waste heat is available from propulsion units and additional transfer brought about by convection. Thus we have a broad statement of the basic problem which is now addressed.

The prior art does have, broadly, systems which combine heat from multiple sources to heat water into steam. However, the use of the heat from marine propulsion has not been combined with the convective heat of original fuel combustion for converting water to steam. In briging about this conversion with a steam generating structure the prior art has not solved the marine problem of limiting the size of the vessels containing the liquid collections being vaporized. An efficient contact between convective heating media and the heated water and vapor downstream of the radiant section of the steam generator has not been disclosed. Where superheating of the steam is required, the structure in which the steam is given its additional heating has not been provided with draining provisions when the system must be temporarily shut down.

The foregoing problems, and others, offer a real challenge to the marine form of steam generator. Each solution may not be individually impressive. Yet, taken together the result is a transformation of steam generation into a marine adaptation which is a significant advance in this particular art.

SUMMARY OF THE INVENTION

The present invention contemplates a steam generator for the marine environment in which its heated surfaces are arranged to absorb heat from both the combustion of original fuel and the heat that would be otherwise wasted as the exhaust of the prime movers which propel the marine vessel. The arrangement for heating with the combination of heat from both sources includes adjusting the ratio of the quantity of heat supplied from each source, depending upon the amount of waste heat available to the total.

The invention further contemplates tubes as the heated surface, the tubes having water pumped through them in forced circulation as the water absorbs heat and is converted to vapor. This contemplation includes the required water-steam separating drum above the heated surfaces and specifically contemplates the lateral dimension of the inventory of water in the drum being kept to a minimum to militate against the effects of marine pitch and roll.

The invention further contemplates a specific arrangement of the tubes in which the saturated steam is further heated into the superheat range. These tubes are first arranged so the heating media flows transverse the length of the tubes. Secondly, the entire set of tube reaches is arranged so it can be readily drained of liquid during periods of shutdown. Finally, the complete set of tube reaches is so mounted within the generator that it can be readily accessible for service and replacement.

Other objects, advantages and features of this invention will become apparent to one skilled in the art upon consideration of the written specification, appended claims, and attached drawings, wherein;

DESCRIPTION OF THE PREFERRED EMBODIMENT

Figure 1:
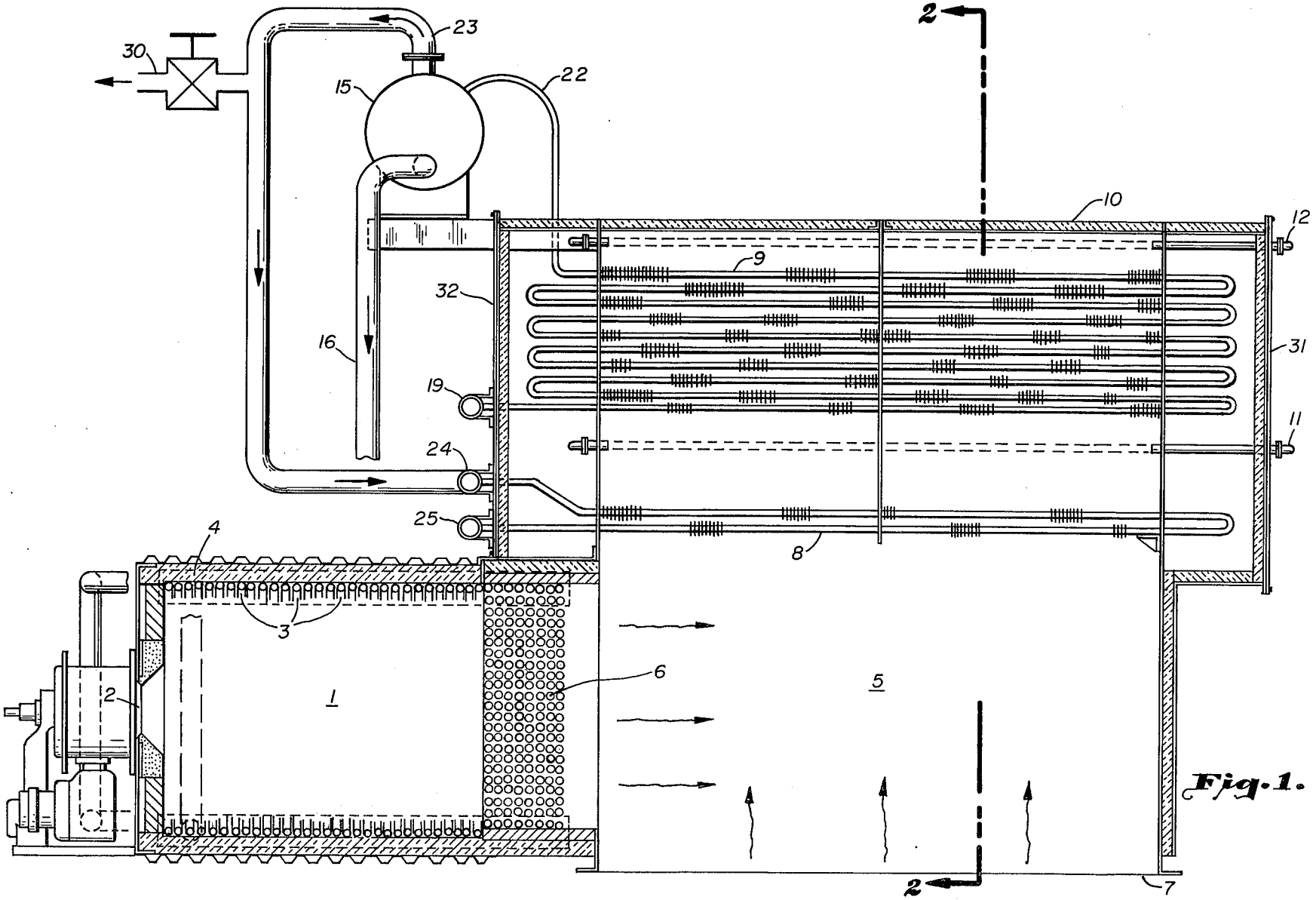
FIG. 1 is a sectioned vertical elevation of a steam generator constructed in accordance with the invention.
Figure 2:
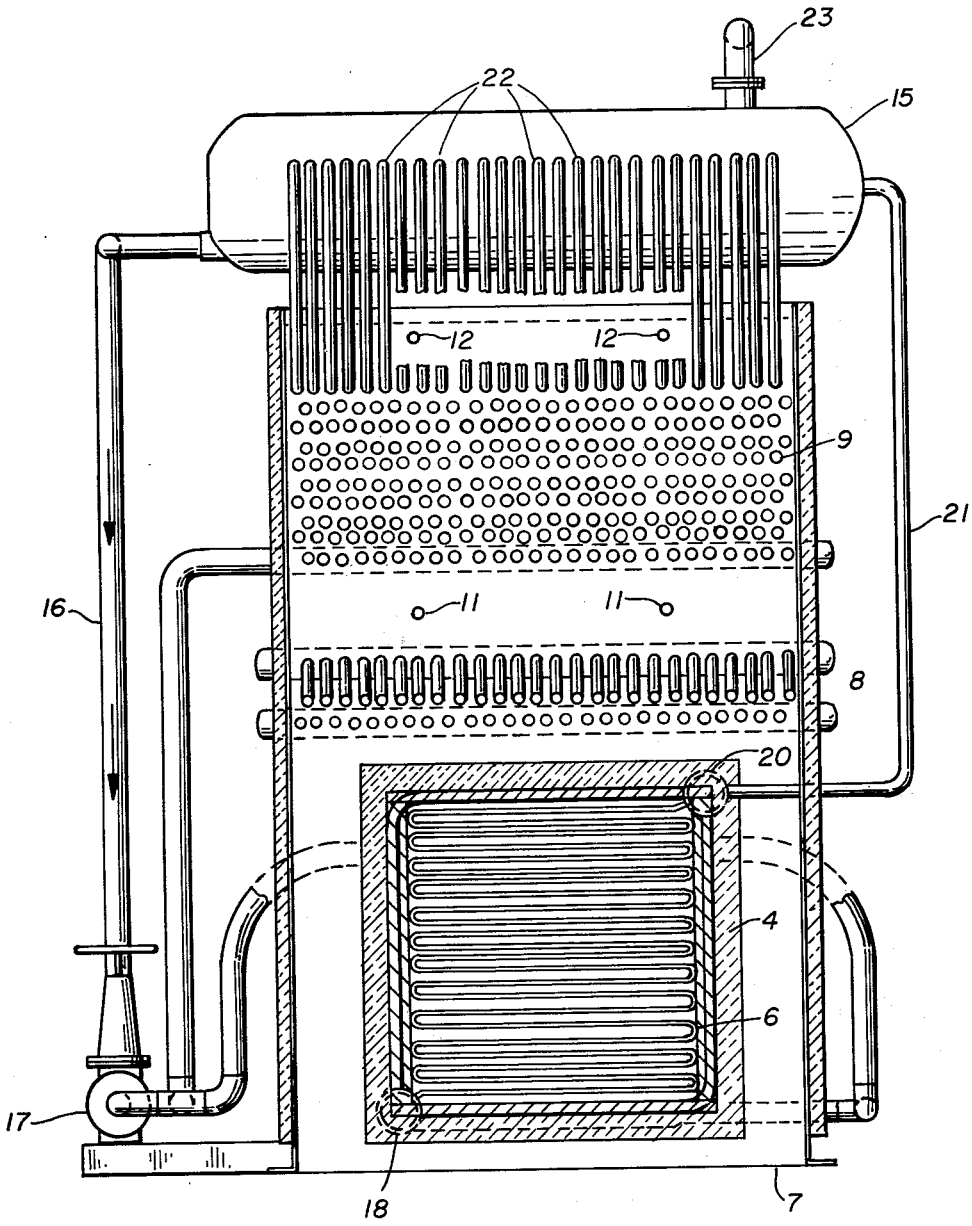
FIG. 2 is a sectioned side elevation of the generator of FIG. 1 taken along lines 2—2 in FIG. 1.

Referring to FIGS. 1 and 2, the basic structures of a steam generator are shown in elevations which are sectioned to give an overall disclosure of the invention. The physical relations of the various sections may be somewhat rearranged in their subjective marine installation. Also, the relative dimensions of the sections may be varied by the capacity required and the amount of waste heat available from the propulsion prime movers of the marine unit. Nevertheless, the concepts of the invention are clearly embodied in this particular drawing and the concepts will be found in any reasonable variation in size and arrangement of the sections of the generator.

The heating begins with the radiant section 1 where a fuel burner is mounted at 2 to generate its flame horizontally within radiant section 1. Tubes 3 are arranged along the walls of this section 1, backed by refractory 4 so they will be exposed to the radiant heat of the burner flame. The products of combustion from the flame flow out of section 1 and into plenum chamber 5, after passing through furnace exit screen tubes 6, where they are mixed with the waste heat from the propulsion unit.

Opening 7 in plenum chamber 5 is arranged from below, assuming the discharge of the propulsion unit is from a lower location. The two sources of heat both discharge into the plenum chamber, mix and flow upward to complete the delivery of this heat to the surfaces of the generator in the boiler section.

Immediately above plenum chamber 5 are arranged the reaches of the superheater tubes 8. Flue gases leaving these tubes flow across vapor generating tubes 9 in the boiler section before exiting through outlet 10. After the final heating of the steam, the flue gases are discharged from the generator.

Soot blowing tubes 11 and 12 are indicated above and below generating tubes 9 in the boiler section. These tubes 11 and 12 represent structure which is of doubtful value in disclosing the invention. Certainly it is not necessary to show details of how these tubes are supplied steam for the purpose of soot blowing.

Many of the structural details of the generator are not made a part of the disclosure. If the structure is a well-known control component, for example, and does not embody a significant concept of the invention, there is no purpose served in cluttering the disclosure with it. An attempt has been made to show selected elements which will orient the disclosure and sharpen the importance of the inventive concepts.

The overall plan for steam generation should now be familiar to one skilled in the art as applied to the present marine installation. Water from the steam drum 15 flows down through downcomer 16 and into the suction side of circulating pump 17 (FIG. 2). The discharge of pump 17 is fed into header 18, which distributes water to tubes 3 and 6. Pump 17 also supplies header 19 with water from which generating tubes 9 are fed.

The mixture of heated water and steam generated in tubes 3 and 6 flows upwardly to header 20. The mixture is passed up to drum 15 through relief line 21. At the same time, generating tubes 9 feed a mixture of steam and water to the drum 15 through relief lines 22.

Saturated steam then flows, from drum 15, through line 23 to the superheater inlet header 24. As this saturated steam flows through superheater 8 it is raised to the desired superheated temperature before leaving through exit header 25. Drawn from header 25, the steam is conducted to its ultimate point of use.

TAP OFF LINE

There are auxiliary services on marine installations which require saturated steam. Demand for saturated steam can occur at any time for this hotel load.

Line 30 is connected to line 23 to route a portion of the saturated steam to the auxiliary services. As described in the drawing, line 30 is provided with a valve. When the time appears for use of the steam, the valve can be operated manually or automatically to direct whatever steam is demanded.

HEAT SOURCES

It has been disclosed from the beginning that heat is provided from multiple sources for this marine steam generator. Alternate sources of heat for steam generation are known in the prior art. However, this concept of combining the heat available from the exhaust of marine propulsion units and the combustion of original fuel is unique.

Plenum chamber 5 has opening 7 for receiving the waste heat, both from propulsion and radiant section 1 from the combustion of original fuel in the radiant section. This structure embodies the concept of making these particular sources of heat available separately, or in combination, for steam generation and superheating. This is unique.

It is contemplated that under most operating situations not all of the steam will be superheated. In that period a portion of the saturated steam may be bled from line 23, through line 30, for use with the auxiliary services. Also, in that period, superheated tubes 8 are protected from excessive heat from radiant section 1 by screen tubes 6. Tubes 6 cool the combustion gas existing from section 1 so that a steam flow through superheat tubes 8 is not required to cool superheat tubes 8.

FORCED CIRCULATION

There is virtue is restating what may now be obvious from the preceding disclosure. The forced circulation feature in the marine boiler is particularly useful. This positive and dynamic control of the water feed to the steam generating tubes avoids the uncertainties of natural circulation under the unstable pitch and roll of marine installation.

Forced circulation, together with the relatively short length for steam drum 15, enables the inventory of liquid to be kept to a minimum. Under the constant marine pressure of space limitation, the features of forced circulation and small steam drum have a decided advantage over the prior art.

TUBE ORIENTATION

General heat transfer guidelines dictate that heating gases from their source should flow transverse the length of tubes in which liquid is vaporized. The heat transfer is more efficient than in an arrangement where the heating media flows the length of the tubes.

The transverse flow principle is included consistently in the disclosed embodiment. Beginning with the radiant section 1, the tubes 3 and 6 are both arranged so the products of combustion from the burner at 2 flow horizontally in section 1 and transversely of the reaches of tubes 3 which are mounted at the wall of refractory 4. Tubes 6 reaches are disclosed as horizontally extended, but whether horizontal or vertical, they are transverse the flow of combustion gases.

As heretofore disclosed, the exhaust gases and burner combustion gas are combined in plenum chamber 5 for upward flow to exit 10. Both superheater tubes 8 and generating tubes 9 are horizontally extended above chamber 5. Therefore, the combined heated gas from chamber 5 flows transverse the reaches of both tubes 8 and tubes 9 to provide the efficient heat transfer.

MODULAR CONSTRUCTION

In bringing together both radiant section 1 and the boiler section above plenum chamber 5, modular concepts have been implemented. Of course both sections are connected by the necessary pipes between the pump 17; the tube sets 3, 6, 8, and 9; and the drum 15. At the same time the two sections are provided the arrangement which inherently lends itself to separate assembly of each section, transport to the site of final assembly and subsequent access for service, repair and replacement.

The boiler section containing both tubes 8 and 9 is further disclosed as particularly arranged for ready access to both sets of tubes. This feature is emphasized by the disclosure of end walls 31, 32 as bolted in place. The boiler section is elevated from, certainly placed separate from, chamber 5 and radiant section 1. So located, there is freedom to unbolt and remove walls 31,

32 to gain access to tube sets 8 and 9 for service, repair or even replacement of these tubes. This feature particularly lends itself to complete drain of the superheater tubes when the generator is shut down.

TEMPERATURE PATTERN

As in all steam generators, the temperatures throughout the structure establish a severe and hostile environment for the materials used. The more severe temperature range in this reduction to practice is in radiant section 1. There the average temperature is in the range of 2500° F. Accordingly, tubes 3 and 6 require an increased amount of cooling.

In design, the temperature in plenum chamber 5 is limited to 900° F. This limitation is imposed by the use of screen tube bank 6 across the exit of radiant section 1. Therefore, corten or carbon steel can be employed for tubes 8 and 9. The screen tubes 6 are therefore the structure which protect superheater tubes 8 from excessive temperature.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

The invention, having been described, what is claimed is:

1. A steam generator for marine installation, including, a radiant furnace section extended horizontally and having walls covered with tubes for water to be heated, a first set of tube reaches extended across the discharge of the radiant furnace section, a plenum chamber positioned horizontally from the radiant furnace section and beyond the set of the tube reaches which extend across the discharge of the radiant furnace section to receive the products of combustion discharged after their passage through the set of tube reaches, an inlet to the plenum chamber and from below the plenum chamber through which waste gases enter the plenum chamber from marine propulsion units to mix with the products of combustion from the radiant furnace section, a second set of tube reaches arranged in parallel and extended horizontally above the plenum chamber so the mixture of heating media discharges upward from the plenum chamber and passes over the reaches in a direction transverse the length of the reaches, a steam-water separating drum mounted above the second set of tube reaches and connected to the tubes, a pump connected to the lower portion of the drum and the tubes to positively fill the drum through the tubes to a predetermined water level, and a source of fuel connected to a burner which is directed to generate products of combustion in the radiant furnace section, whereby the combination of heat sources directed into the plenum chamber supplies heat to the tubes of the generator to develop saturated steam in the drum which is then superheated in the second set of tube reaches as an output of the generator.

2. A marine steam generator, including, a radiant section extended horizontally and in which a burner is mounted to generate products of combustion, tubes mounted on the walls of the radiant section for exposure to radiant heat from the combustion at the burner, a plenum chamber mounted horizontally from and adjacent to the radiant section and connected with the radiant section to receive the products of combustion, a boiler section having tubes mounted vertically above the plenum chamber and connected to the plenum chamber to receive heating gases from the chamber, a marine propulsion unit connected and arranged to exhaust its gases into the plenum chamber superheat tubes mounted in the boiler section and connected to receive saturated vapor from the radiant and boiler section tubes and superheat the vapor for driving an electrical generator, and a removable wall portion of the boiler section for providing ready access to the superheat tubes for their service, repair and replacement.

3. The generator of claim 2, including, a steam-water drum mounted above the boiler section and connected to tubes in the radiant section and tubes in the boiler section and the superheat tubes for separating saturated vapor from liquid and delivering the saturated vapor to the superheat tubes, and a pump connected to the tubes and drum for circulating liquid and vapor between the tubes and the drum.

4. The generator of claim 3 wherein, the drum is provided with a relatively short horizontal length and the liquid inventory of the tubes and drum is relatively small.

5. The generator of claim 2 wherein, the relative arrangement of the axis of the tubes mounted in the radiant section and the axis of the superheat tubes and the direction of flow for the products of combustion from the burner is that the flow is maintained transverse the axis of the tubes.

* * * * *